United States Patent [19]

Grabbe

[11] Patent Number: 4,635,595

[45] Date of Patent: Jan. 13, 1987

[54] STARTING METHOD FOR INTERNAL COMBUSTION ENGINE

[75] Inventor: Dieter Grabbe, Hamburg, Fed. Rep. of Germany

[73] Assignee: Societe d'Etudes de Machines Thermiques, Saint Denis, France

[21] Appl. No.: 746,290

[22] Filed: Jun. 19, 1985

[30] Foreign Application Priority Data

Jun. 19, 1984 [FR] France ..... 84 09583

[51] Int. Cl.[4] ..... F02N 9/04

[52] U.S. Cl. ..... 123/179 F; 60/625

[58] Field of Search ..... 123/90.16, 179 F, 179 A; 60/625, 630

[56] References Cited

U.S. PATENT DOCUMENTS

| | | | |
|---|---|---|---|
| 1,939,350 | 12/1933 | Jendrassik | 123/179 F |
| 2,260,983 | 10/1941 | Walker | 123/90.16 |
| 2,266,077 | 12/1941 | Roan | 123/90.16 |
| 3,032,965 | 5/1962 | Wistner | 123/179 F |
| 3,626,918 | 12/1971 | Brenneke | 123/179 F |
| 4,324,212 | 4/1982 | Samuel et al. | 123/179 F |

FOREIGN PATENT DOCUMENTS

| | | |
|---|---|---|
| 2465071 | 3/1981 | France . |
| 0125795 | 5/1928 | Switzerland . |

*Primary Examiner*—Willis R. Wolfe, Jr.
*Attorney, Agent, or Firm*—Kenyon & Kenyon

[57] ABSTRACT

Starting method for an internal combustion engine at least one cylinder whereof is equipped with a starting valve connected to a source of compressed fluid, said fluid being introduced into the cylinder or cylinders when the pistons are in the combustion phase of the engine cycle, whereby the opening lead of the exhaust valve or valves of each cylinder equipped with a starting valve is temporarily reduced to improve utilization of the energy contained in the starting fluid.

3 Claims, 2 Drawing Figures

STARTING METHOD FOR INTERNAL COMBUSTION ENGINE

This invention concerns a method of starting an internal combustion engine.

Starting of high powered internal combustion engines, particularly diesel engines, is obtained by introducing compressed air into the cylinders during the downstroke of the pistons corresponding to the combustion phase of the cycle. The compressed air pushes back the pistons one after another and brings about rotation of the crankshaft and thereafter the compression of the air admitted to the other cylinders.

In a known manner, the starting air, at a pressure of about 30 bars, is introduced into the cylinders by means of special valves, known as starting valves, controlled by the angular position of the camshafts.

In normal operation, the exhaust valves open a few degrees (roughly 30°) before the piston reaches bottom dead center. However, this advancing of exhaust valve opening has a disadvantage for air-starting of engines because part of the energy contained in the compressed air is wasted at this time. The present invention is thus directed to delaying exhaust valve opening in order to make better use of the energy contained in the compressed air.

The invention provides a starting method or procedure for an internal combustion engine, and in particular a diesel engine, having an exhaust valve opening lead at the end of the gas expansion stroke and at least on cylinder with a starting valve connected to a source of compressed fluid and piloted by a control circuit such as to introduce the starting fluid into the concerned cylinders when the pistons are in the combustion phase or power stroke of the cycle, said method characterized in that the opening lead of the exhaust valve or valves of each cylinder equipped with a starting valve is temporarily reduced to improve utilization of the energy contained in the starting fluid.

Preferably, said temporary reduction in duration of the valve opening lead is servoed to the duration of the starting sequence and amounts to one third of the angle of crankshaft rotation corresponding to said opening lead.

The invention also provides an engine applying the starting procedure according to the invention.

An example of a starting method according to the invention will now be described with reference to the appended drawings, in which.

Figure 1:
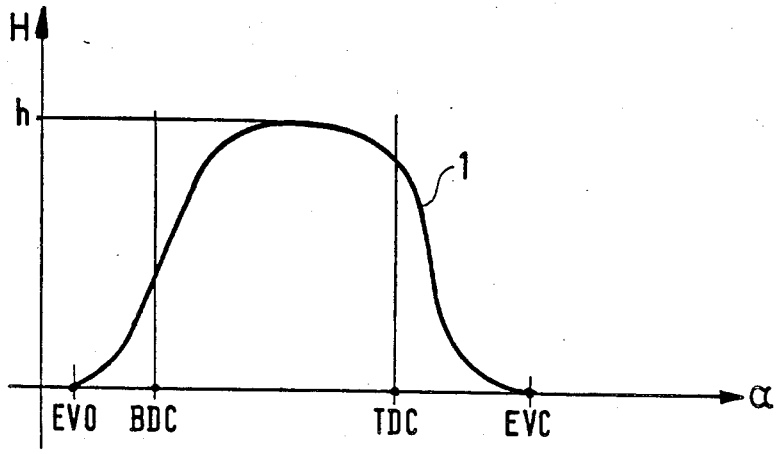
FIG. 1 is a valve opening diagram for an exhaust valve during normal operation.

Referring first to FIG. 1, curve 1 therein plots the opening of an exhaust valve in normal operation. The rotational angle $\alpha$ of the crankshaft is plotted along the X-axis and the height H of valve lift above its seat is plotted along the Y-axis.

Point EVO represents the instant of exhaust valve opening; point BDC represents bottom dead center and point TDC, top dead center of the piston. The distance between point EVO and point BDC represents the amount of lead, in angular degrees, of the exhaust valve's opening. Point IVC represents the instant of exhaust valve closing and height h the maximum amount of valve lift.

Figure 2:
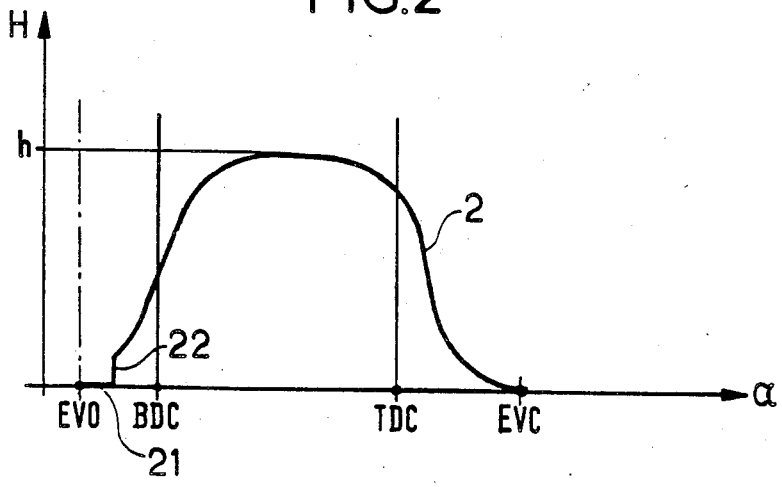
FIG. 2 is a valve opening diagram for an exhaust valve during engine starting.

FIG. 2 plots a curve 2 representing the opening of an exhaust valve in a cylinder equipped with a starting valve during the starting phase, using the same coordinates and timing points as FIG. 1.

The key difference between curve 2 and curve 1 resides in portion 21 where curve 2 illustrates the retarding of exhaust valve opening. Curve portion 22 represents the valve's return to normal operation as in curve 1 of FIG. 1. Indeed, the remainder of curve 2 beyond portion 22 is identical to curve 1. It deserves to be pointed out nevertheless that, depending on the specific device used to retard valve opening, there may be a slight difference in the maximum height of valve lift h and/or the instant of exhaust valve closing IVC, between curves 1 and 2. This will not adversely affect engine operation, even at startup, however.

The valve's return to normal operation according to curve 1 is servoed to the duration of the starting sequence.

Portion 21 of curve 2 represents at least $\frac{1}{3}$ of the rotational angle of the crankshaft corresponding to this advance.

Such retarding of exhaust valve opening can be obtained by known means such as by an eccentric mounted on the shaft of a rocker arm to provide additional play in the kinematic linkage controlling the valves, or by a device operable to move an intervening part between a valve tappet and the corresponding cam to retard the cam's action on the tappet.

This procedure provides for easy starting of all engines, irrespective of their number of cylinders, and in particular of engines having become permeable as a result of specially timing their intake and exhaust cams and of their number of cylinders, engines for example with five in-line cylinders or V-10s with only one line of cylinders used for starting.

I claim:

1. A method for starting an internal combustion engine having a crankshaft, at least one working cylinder with a piston connected to the crankshaft for reciprocation between an initial dead center position and a final dead center position in a combustion stroke, the cylinder being equipped with an exhaust valve that opens during normal running of the engine no later than a preselected angle of the crankshaft in advance of the final dead center position of the piston in the combustion stroke and a starting valve connected to a source of compressible starting fluid under pressure, the method comprising:

opening the starting valve to introduce pressurized starting fluid into the cylinder during the combustion stroke in a starting sequence of the engine and temporarily retarding the opening of the exhaust valve beyond said preselected angle of the crankshaft during the starting sequence to improve utilization of the potential energy contained in the pressurized starting fluid.

2. The method of claim 1 wherein the step of temporarily retarding the opening of the exhaust valve comprises servoing the retardation of the exhaust valve opening to the duration of the starting sequence.

3. The method of claim 1 or 2 wherein the step of temporarily retarding the opening of the exhaust valve comprises retarding the exhaust valve opening by an angular amount equal to at least one-third of said preselected advance angle.

* * * * *